US005503047A

United States Patent [19]

Brockington

[11] Patent Number: 5,503,047

[45] Date of Patent: Apr. 2, 1996

[54] CORDLESS ELECTRIC CORKSCREW

[76] Inventor: F. Rhett Brockington, 4016 MacGregor Dr., Columbia, S.C. 29206

[21] Appl. No.: 372,306

[22] Filed: Jan. 13, 1995

[51] Int. Cl.[6] ..... B67B 7/04

[52] U.S. Cl. ..... 81/3.2; 81/3.29; 81/3.45

[58] Field of Search ..... 81/3.2, 3.29, 3.45

[56] References Cited

U.S. PATENT DOCUMENTS

| | | | |
|---|---|---|---|
| 5,031,486 | 7/1991 | Rydgren . | |
| 5,079,975 | 1/1992 | Spencer . | |
| 5,086,675 | 2/1992 | Leung . | |
| 5,095,778 | 3/1992 | Bocsi et al. | 81/3.2 |

FOREIGN PATENT DOCUMENTS

| | | | |
|---|---|---|---|
| 2660299 | 3/1990 | France . | |
| 1920224 | 11/1970 | Germany | 81/3.2 |
| 3713263 | 11/1988 | Germany | 81/3.2 |

*Primary Examiner*—James G. Smith

*Attorney, Agent, or Firm*—F. Rhett Brockington

[57] ABSTRACT

A mechanized corkscrew powered by a cordless electric screwdriver, that mimics a winged manual corkscrew, wherein the mechanized corkscrew has a bell shaped flange on a sliding element that retracts up a twin threaded shaft as the corkscrew is twisted into the cork, and then, once the corkscrew is embedded in the cork, the sliding element traverses back down the twin threaded shaft, the resulting action causing the corkscrew to pull the cork out of the bottle.

10 Claims, 3 Drawing Sheets

CORDLESS ELECTRIC CORKSCREW

The invention relates generally to corkscrews and more particularly to mechanized corkscrews which are driven by electrical motors powered by a battery energy source.

BACKGROUND

Cork, (Gk. phellos), is a compressible wood having low water absorption derived from the meristem bark of live oaks. It has been known to be in use since 400 BC. Cork has been used to close bottles, and in particular wine bottles, since the 1600's. The elastically compressible nature of cork, coupled with its low absorption of water, make it ideally suited as a closure material, because it conforms to openings, even those having a somewhat irregular shape, forming a water tight seal.

Cork is still in use today by wine vintners, in part because of its historically proven successful performance, and also because it embodies the public's perception of the bottling method of choice, especially for finer wines. A certain savoir faire is often associated with the opening of a bottle of wine, and a variety of uncorking devices have been developed to assist in the presentation. The uncorking task is complicated by the nature of the cork material. While cork is elastically compressible, it is also somewhat friable, and is subject to crumbling when dry or exposed to excessive force. Being a natural product there is also an inherent degree of nonhomogeneity. The cumulative effect of these factors has resulted in a plethora of uncorking devices. Most of the more recent inventions use a worm-like helical "shaftless" corkscrew to minimize the over-all expansion of the cork when the corkscrew is inserted. Expansion is undesirable as it increases the radial force on the perimeter of the cork against the interior wall of the neck of the bottle, making the cork harder to extract. The older type of corkscrew is the auger "shaft" type corkscrews. The inserted "shaft" tends to expand the cork outwards, making uncorking more difficult. Rydgren U.S. Pat. No. 5,031,486 discusses this effect. Note, that both types of corkscrews have a very low thread count with a high degree of pitch and a wide flight so as to distribute the twisting action through out the cork, therein reducing the probability of the cork crumbling. Other, uncorking devices have been described in the literature, such as needles through which a gas is pumped into the bottle, but in general these techniques have not enjoyed the commercial success of the corkscrew.

Mechanized corkscrews, and in particular electric corkscrews, have been described in the prior art, as a means of automating the uncorking process. Manual uncorking using a corkscrew is not particularly physically rigorous, however it does require a repetitious twisting action, which can become difficult after several bottles. The twisting action can be extremely painful for someone with arthritis, or carpal tunnel syndrome. Mechanized corkscrews alleviate the twisting action, and all but eliminate the physical effort, however, generally, with coincident deleterious effects on the cork. For instance, Spencer U.S. Pat. No. 5,079,975 discloses an automatic corkscrew, wherein the force of the rotating corkscrew extracts the cork into the "extraction tube" . During the extraction, the corkscrew penetrates through the base of the cork, which can result in cork grinds being conveyed into the bottle. Secondly, the torque required to extract the cork is on the order of 2–3 times the torque required to twist the corkscrew into the cork, reaching a peak torque just prior to the cork yielding to the extraction forces. Twisting the corkscrew into the cork requires only approximately 1 Newton-meter, however to pull the cork out using a corkscrew with a 45 degree pitch (1.4 mechanical advantage) varies depending on the percent of compression and nature of the cork, but is generally on the order of 2.5–3.5 Newton-meters. This level of torque would create a pulling force of 26 to 38 Kg on the cork. This is sufficient force to cause considerable grinding action on the cork by the rotating corkscrew, hence the coincident deleterious effects on the cork.

Another consideration, particularly for battery powered corkscrews as disclosed in Spencer U.S. Pat. No. 5,079,975, is that the readily available commercial drivers have only a finite amount of dynamic torque. The dynamic torque, while being more than adequate for twisting in the corkscrew, is, without gear reduction modification or a much more expensive driver, marginal at the peak torque demand during the cork extraction. The problem of marginal torque is further exacerbated wherein it is desirous to extract the cork without previously removing the packaging seal. It should be noted that in serving large parties of people, where one is most likely to employ an electric corkscrew, the packaging seal is frequently not removed, because it takes as much time to take it off as it does to uncork the bottle.

Accordingly, a statement of the problem is the need for a mechanized corkscrew which mimics the action of a manual corkscrew, wherein the bottom of the cork is not pierced during the uncorking. Like a manual corkscrew, the mechanized corkscrew has to be portable, being easily taken to a table, and preferably cordless. It should rapidly de-cork(discharge the cork), and be ready for reuse. Twisting movement should be kept to a minimum. A further desirable feature is the ability to partially extract the cork, such that at a later time the cork can be removed from the bottle by hand just prior to pouring.

A narrower statement of the problem is the need for a mechanized corkscrew which can mimic the action of a winged manual corkscrew. The winged manual corkscrew has a sliding element that consists of a bell shaped flange and a geared cam, lever arm assembly. The bell shaped flange aligns the corkscrew centrally over the cork. The corkscrew is distally mounted on a notched shaft which moves on a bearing coaxially within the sliding element, wherein movement of the corkscrew relative to the sliding element rotates a pair of cam shaped gears on the sliding element which are engaged with the notched shaft. Each of the cam shaped gears has a lever arm (wing), and the wings pivot upward as the corkscrew moves downward. To uncork a bottle using the winged manual corkscrew, the same is positioned atop the bottle. The bell shaped flange settles flush and collinearly with the mouth of the bottle, therein aligning the concentric corkscrew, which is recessed within a bore of the sliding element, with the center of the cork. The corkscrew is twisted into the cork, and as it penetrates the cork, moving downward relative to the sliding element, the wings are raised. When the corkscrew has been twisted into the cork approximately 35 mm, the wings have been raised from a vertical to a horizontal position. The cork is extracted by applying equal and downward force on the opposing wings, which cause the corkscrew to move upward relative to the sliding element. The cork, which is embedded with the corkscrew, is pulled out of the bottle into the bell shaped flange and the bore of the sliding element. The winged manual corkscrew is de-corked by counter-rotating the corkscrew while holding the cork.

There are several features that bear some emphasis, when examining the action of the winged manual corkscrew, which in operation is similar to almost all manual corkscrews. The first feature is that the corkscrew is not used as an auger for conveying the cork out of the bottle, but simply as a means of attaching the cork to a lever arm, in this case a pair of lever arms. The consistency of cork is such that it is likely to crumble if augered, and some of the grinds will end up in the bottle. Secondly, the force required to pull the cork out of the bottle can be significant, and is variable from bottle to bottle, as a consequence of the natural variability of cork. Thirdly, during the extraction, there is no twisting, as this would make it difficult to keep the bottle from spinning while simultaneously manning the corkscrew.

Therein, the instant invention is a mechanized corkscrew which mimics the action of a winged manual corkscrew, that consists of a corkscrew apparatus and a mechanical power source, wherein the mechanical power source is preferably a cordless electric reversible motor powered by interchangeable, rechargeable batteries. The instant invention is designed to uncork a wine bottle in 3 or 4 seconds, and can be de-corked and reset in a matter of just a few seconds.

SUMMARY OF THE INVENTION

The instant invention is a mechanized corkscrew consisting of a corkscrew apparatus and a mechanical power source, wherein the mechanical power source is a reversible motor. The reversible motor is preferably the type used for in-line, cordless electric screwdrivers, which consists of a rechargeable battery, a direct current electric motor, a planetary gear reduction assembly linked to a hex-shaft collet, a durable plastic housing, and a forward reverse switch. Typically the output speed is 180 rpm, having a dynamic torque of 1.6 to 2.7 Newton-meters. Two prominent manufacturers in the United States are Skil and Black & Decker.

The corkscrew apparatus consists of a corkscrew distally mounted on a twin threaded shaft, a sliding element, and a housing. Preferably, the corkscrew apparatus is also inclusive of a spring, which augments the extraction. The sliding element is substantially cylindrical in shape, and consists of a translational bearing, a follower and a tubular slide, wherein the sliding element is bored out more in regions that do not function as a bearing. The tubular slide has a receiving chamber and a bell shaped flange. The bell shaped flange centers the corkscrew on the mouth of the bottle and tends to funnel the extracting cork into the receiving chamber. The receiving chamber has a bore that is slightly larger than the diameter of a wine bottle cork, and a length that is at least twice the length of a cork. Along a sectional portion of the longitudinal axis of the receiving chamber there is a cork chock, which can be used to prevent the cork from rotating once it is in the receiving chamber. The follower is a pawl that forces the sliding element to track on the translational bearing, back and forth over the twin threaded shaft, which has a continuous thread, as the twin threaded shaft rotates. The sliding element has a key and a keyway that interlocks with a complementary keyway on the housing such that, when the twin threaded shaft rotates, the sliding element can traverse, but not rotate. The housing is substantially a double chambered pipe with a stationary bearing. The housing serves to mount the corkscrew apparatus to the mechanical power source, support the twin threaded shaft, and prevent the sliding element from rotating. The housing has a collet chamber, wherein the twin threaded shaft is linked to the mechanical power source, and in a preferred embodiment this is the collet of the cordless electric screwdriver, as previously described. There is also a slide chamber, and the slide chamber houses the sliding element. There is a substantial wall between the collet chamber and the slide chamber which is bored out to form the stationary bearing for the twin threaded shaft. The stationary bearing is coaxial with the housing and collinear with the twin threaded shaft. The stationary bearing supports the twin threaded shaft. A set of retaining rings snapped into circumferential grooves on the twin threaded shaft hold the twin threaded shaft in the stationary bearing. There is preferably a spring mounted in the substantial wall on the slide chamber of the housing. The spring is at maximum compression when the sliding element has traversed to its furthest point of retraction, which is a point proximal to the stationary bearing.

The instant invention mimics the action of a winged manual corkscrew as follows. The action has two phases, the cork penetration phase and the extraction phase. To begin the cork penetration phase, actuate the mechanical power source until the sliding element traverses to its maximum extension, such that the corkscrew is recessed in the receiving chamber. Position the bell shaped flange on the mouth of the bottle to be uncorked. The bell shaped flange settles flush and collinearly with the mouth of the bottle, therein aligning concentrically the corkscrew, with the center of the cork. Actuate the mechanical power source, such that the corkscrew is rotating clockwise when viewed from above. Actuation corresponds to hand twisting the corkscrew on the winged manual corkscrew. The threads on the twin threaded shaft are cut with the same pitch as the corkscrew, so that as the corkscrew penetrates the cork, the sliding element retracts at the same rate, just like the corresponding sliding element on the winged manual corkscrew. As the sliding element retracts it begins to compress the spring. The corkscrew attains a depth of approximately 35 mm into the cork before the sliding element reaches the top of its translational cycle and starts moving downward. Downward movement of the sliding element signifies the beginning of the extraction phase. The spring starts decompressing, pushing the sliding element downward, releasing energy that was stored in the spring during the cork penetration phase. This point in the action corresponds to the point in the winged manual corkscrew cycle when the wings are horizontal, and force is just being applied downward, resulting in the corkscrew moving upward relative to the sliding element. The torque requirements for the corkscrew apparatus triple in a matter of a half turn of the twin threaded shaft, however the excess energy stored in the spring is more than enough to compensate for the increase. The downward movement of the sliding element presses the bell shaped flange firmly against the mouth of the bottle causing the cork to start to move. The pressure of the bell shaped flange tends to neutralize the twisting action of the corkscrew as it continues to rotate. Very shortly after the cork starts moving upward out of the bottle, the cork starts to rotate such that there is very little additional penetration of the corkscrew into the cork. The cork will continue to rotate until the cork chock is engaged.

The tubular slide of the sliding element is lined exteriorly with graduations which indicate how far the cork has been extracted. These graduations can be useful if it is desirable to only partially uncorked the bottle while the packaging seal has been left on the bottle, as the cork is not easily visible. To de-cork, just reverse the mechanized power source after engaging the cork chock, and the corkscrew will back out.

It is anticipated that through a modification to the housing, the corkscrew apparatus can be designed such that said corkscrew apparatus could have a quick connect means such that it could be snapped on the mechanized power source, instead of being fastened with screws as is disclosed in the foregoing illustrated embodiment.

DETAILED DESCRIPTION OF THE ILLUSTRATED EMBODIMENT

Figure 1:
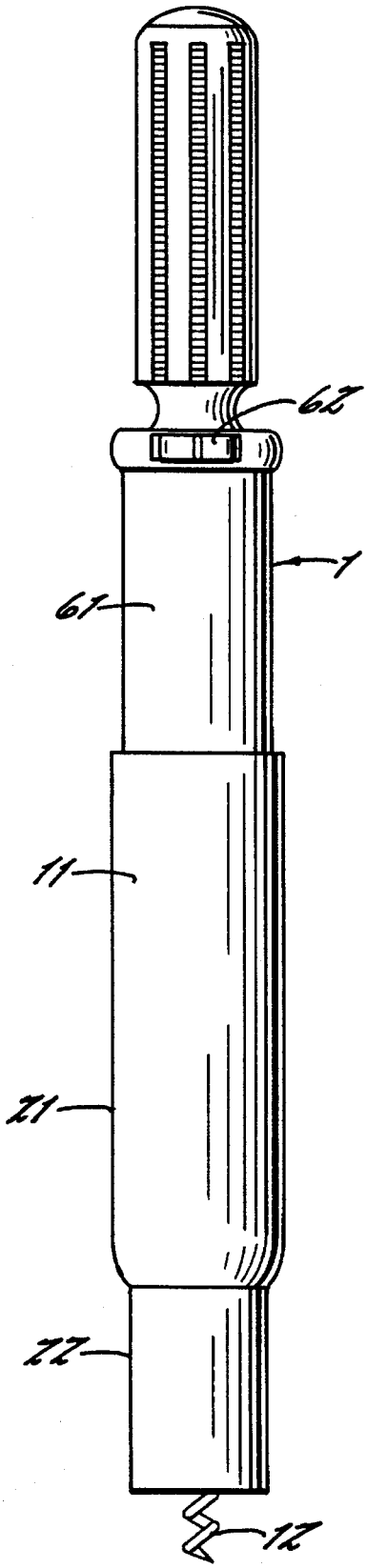
FIG. 1 is a perspective view of the illustrated embodiment, inclusive of the mechanized power source and the corkscrew apparatus, embodying features of the instant invention.

Referring now to the drawings, in FIG. 1 the mechanized corkscrew 1 consists of a corkscrew apparatus 11 and an in-line, cordless electric screwdriver 61. The electric screwdriver 61 consists of a rechargeable battery, a direct current electric motor, a planetary gear reduction assembly linked to a hex-shaft collet, a durable plastic housing, and a forward / reverse switch 62. Typically the output speed is 180 rpm, having a dynamic torque of 1.6 to 2.7 Newton-meters.

Figure 2:
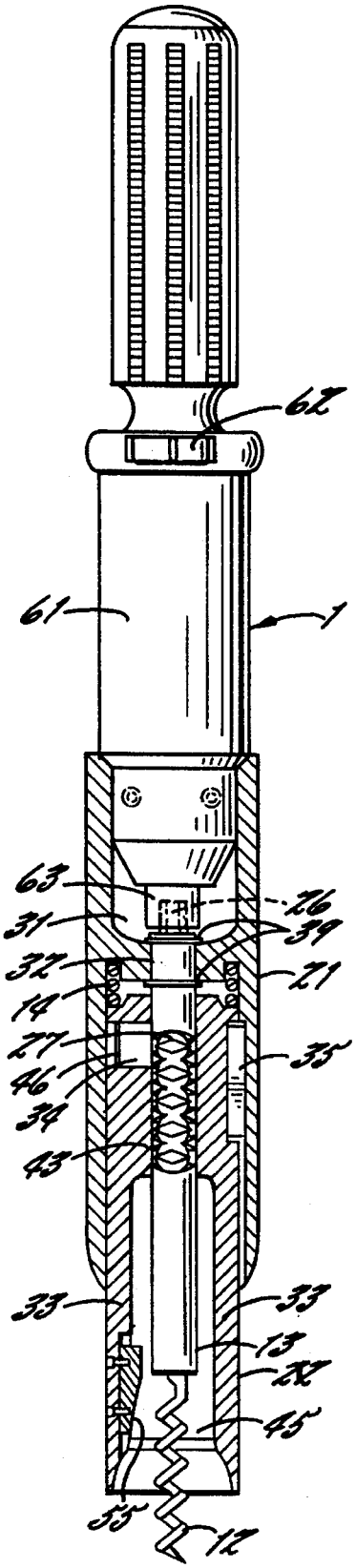
FIG. 2 is a section away view of the corkscrew apparatus of the invention illustrated in FIG. 1.
Figure 4:
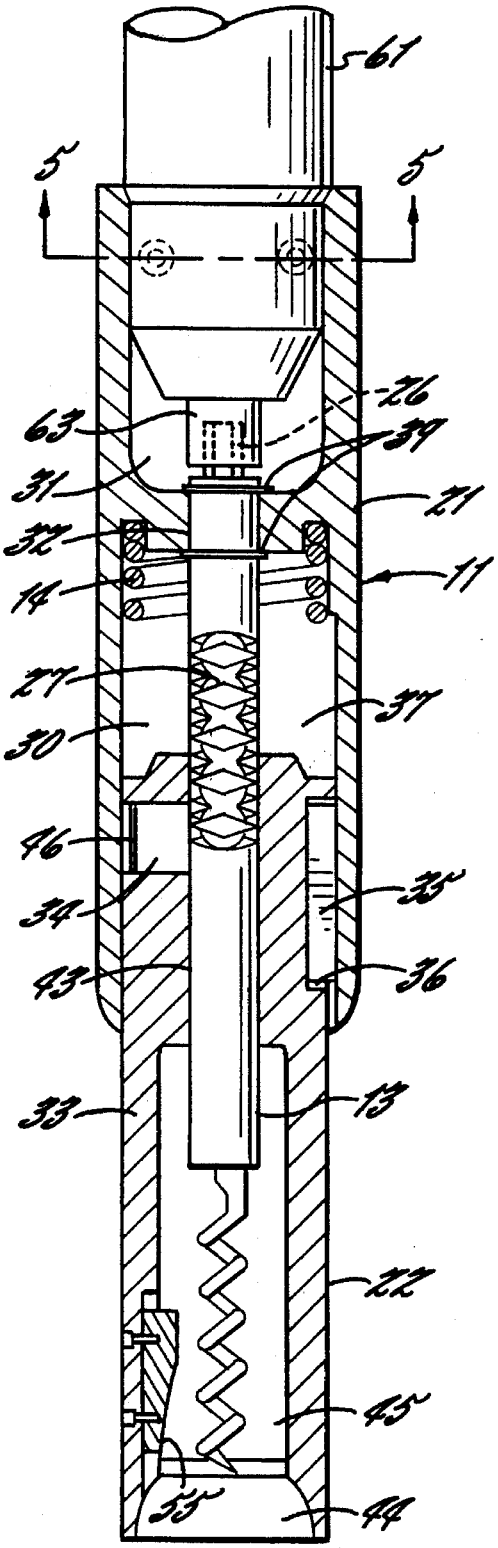
FIG. 4 is a variation of FIG. 3, wherein the sliding element, which is fully retracted in FIG. 3, is shown fully extended in FIG. 4.
Figure 3:
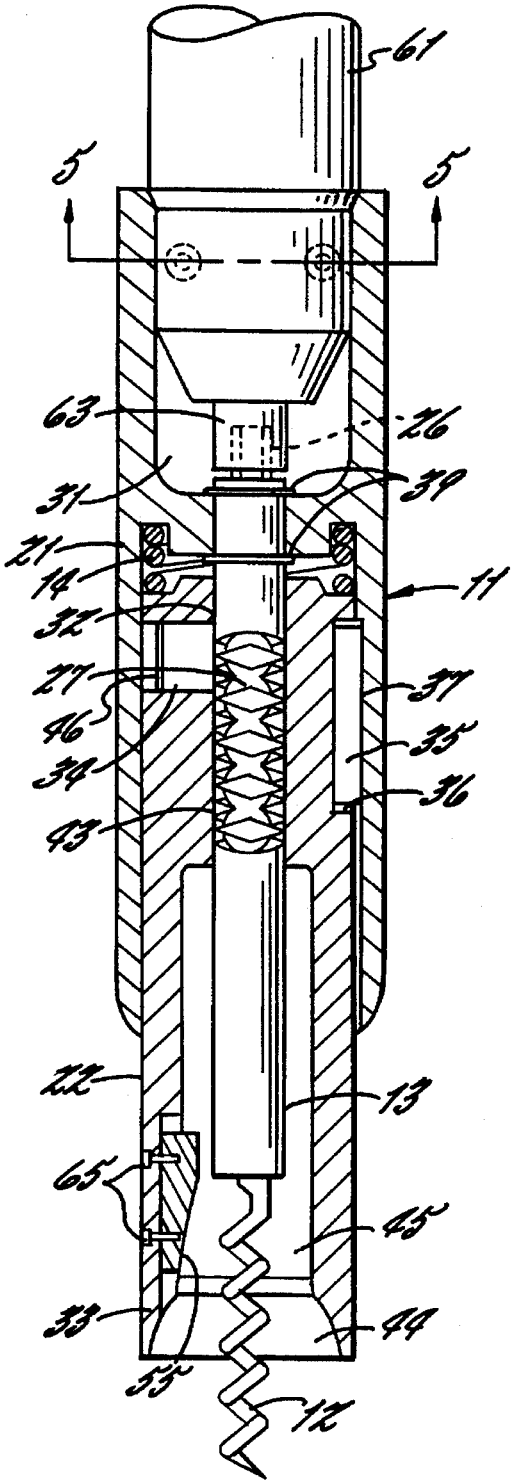
FIG. 3 is an enlarged view of the corkscrew apparatus only, illustrated in FIG. 2.
Figure 5:
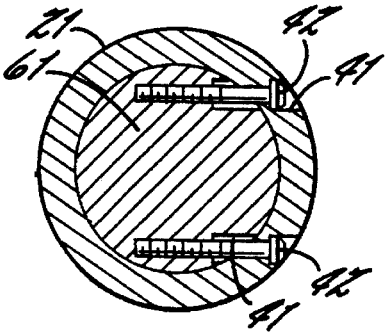
FIG. 5 is a sectional view of the structure illustrated in FIG. 3, taken along line 5—5 thereof.
Figure 6A:
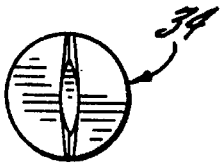
FIG. 6A–6C are axial views of the follower, to illustrate how the pawl tracts the continuous thread of the twin threaded shaft.
Figure 6B:
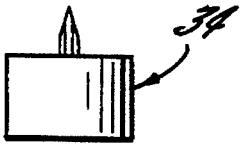
Figure 6C:
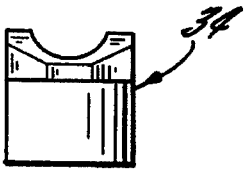

The corkscrew apparatus 11 consists of a housing 21, and a sliding element 22. The corkscrew apparatus 11 is mounted to the electric screwdriver 61 using a pair of self tapping pan head screws 42 through mounting holes 41. FIG. 5 is a sectional view of the structure illustrated in FIG. 3, taken along line 5—5 thereof. The sliding element 22, as illustrated, is retracted exposing the corkscrew 12. The section view of corkscrew apparatus 11 of the mechanized corkscrew 1 as shown in FIG. 2 illustrates the internal workings of the instant invention, and shows the relative position of the components. FIG. 3 is the section view of just the corkscrew apparatus 11. FIG. 4 is the same view, except that the sliding element 21 is in the fully extended position. Referring to FIG. 4, the housing 21 is substantially a double chambered pipe and a stationary bearing 32. The two chambers are the collet chamber 31 and the slide chamber 30. There is a bore coaxial to the housing 21 between the collet chamber 31 and the slide chamber 30, in a substantial wall which is the stationary bearing 32. The twin threaded shaft 13 projects coaxially down the housing 21. The proximal end of the twin threaded shaft 13 in the collet chamber 31 has a hexagonal stem 26, which inserts into collet 63 of the electric screwdriver 61. The twin threaded shaft 13 is supported by stationary bearing 32, and is held in position by a pair of external retaining rings 39, which are snapped into the respective circumferential grooves 28. See FIG. 7 for a blow up of the twin threaded shaft 13. A continuous thread 27 is cut into the twin threaded shaft 13, in a right handed and a left handed thread pattern. The slide chamber 30 houses the sliding element 22. The sliding element 22 consists of a follower 34, a translational bearing 43 and a tubular slide 33 that is comprised of a receiving chamber 45, a bell shaped flange 44, and a cork chock 55. The follower 34 is a pawl that forces the sliding element 22 to track on the translational bearing 43, back and forth over the twin threaded shaft when it rotates. The follower is held in position, but free to rotate by internal retaining ring 46. The follower 34 is shown from all three axial perspectives in FIG. 6A–6C.

The sliding element 22 has a key 35 mounted in a longitudinal keyway 36 that interlocks with a complementary keyway 37 on the housing 21 such that, when the twin threaded shaft 13 rotates, the sliding element 22 can traverse, but not rotate. The cork chock 55 is held in position in the receiving chamber 45 by a pair of screws 65.

A compression spring 14 is situated in a depression in the wall of the slide chamber 30, that compresses when the sliding element 22 moves to the retracted position shown in FIG. 3, and is fully decompressed in the extended position shown in FIG. 4.

Figure 7:
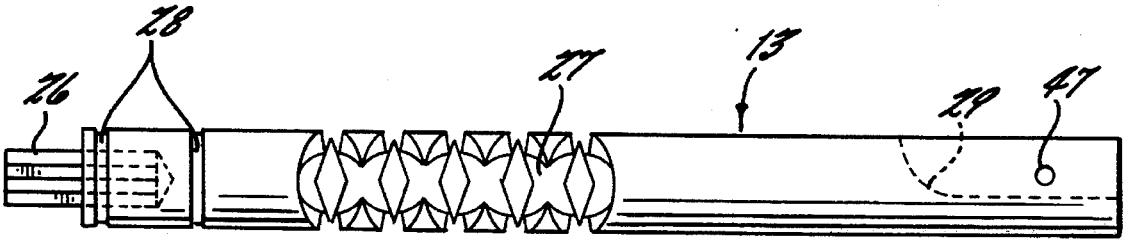
FIG. 7 is a view of the twin threaded shaft.
Figure 8:
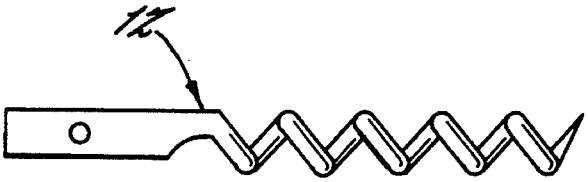
FIG. 8 is a view of the worm-like helical "shaftless" corkscrew.

The corkscrew 12, as blown up in FIG. 8, is mounted on the distal end of the twin threaded shaft 13 in a longitudinal groove 29 cut through the axis of the twin threaded shaft 13. FIG. 7 shows the longitudinal groove 29. The corkscrew 12 is held in position by spring pin 47. The twin threaded shaft 13 and the follower 34 are formed of 4140 steel. The corkscrew 12 is made from chrome plated steel. The housing 21 and the sliding element 22 are made of Nylon 6.

It is a anticipated that the entire corkscrew apparatus 11 can be fabricated using engineering plastics.

I claim:

1. A mechanized corkscrew consisting of a corkscrew apparatus and a mechanized power source, wherein the corkscrew apparatus consists of the following:

- a corkscrew distally mounted on a twin threaded shaft, wherein the twin threaded shaft has a continuous thread;
- a sliding element consisting of:
  - a tubular slide comprised of a receiving chamber, a bell shaped flange, and a cork chock,
  - a translational bearing for traversing movement over the twin threaded shaft,
  - a follower which is a pawl that forces the sliding element to track the continuous thread, back and forth over the twin threaded shaft, as the twin threaded shaft rotates,
  - a keyway which prevents the sliding element from rotating;
- a housing consisting of:
  - a collet chamber for mounting the corkscrew apparatus to the mechanical power source,
  - a slide chamber for housing the sliding element and fitted with a complementary keyway which interlocks with the sliding element and prevents the sliding element from rotating,
  - a stationary bearing for supporting the twin threaded shaft.

2. A mechanized corkscrew consisting of a corkscrew apparatus and a mechanized power source, wherein the corkscrew apparatus consists of the following:

- a corkscrew distally mounted on a twin threaded shaft, wherein the twin threaded shaft has a continuous thread;
- a sliding element consisting of:
  - a tubular slide comprised of a receiving chamber, a bell shaped flange, and a cork chock,
  - a translational bearing for traversing movement over the twin threaded shaft,
  - a follower which is a pawl that forces the sliding element to track the continuous thread, back and forth over the twin threaded shaft, as the twin threaded shaft rotates, a keyway which prevents the sliding element from rotating;

a housing consisting of:

a collet chamber for mounting the corkscrew apparatus to the mechanical power source, a slide chamber for housing the sliding element and fitted with a complementary keyway which interlocks with the sliding element and prevents the sliding element from rotating, a stationary bearing for supporting the twin threaded shaft, a spring, located between the stationary bearing and the sliding element, that decompresses during extraction of a cork, therein augmenting extraction.

3. A mechanized corkscrew as claimed in claim 1, wherein said mechanized power source is an in-line, cordless electric screwdriver.

4. A mechanized corkscrew as claimed in claim 3, wherein said in-line, cordless electric screwdriver is capable of producing at an output speed of 180 rpm, a dynamic torque of 2.7 Newton-meters, and said in-line, cordless electric screwdriver is interchangeably fitted with a rechargeable battery.

5. A mechanized corkscrew as claimed in claim 1, wherein said continuous thread of the twin threaded shaft is a deeply cut groove with a pitch that substantially matches the pitch of the corkscrew, with an over-all threaded length of 40 mm.

6. A mechanized corkscrew as claimed in claim 1, wherein said twin threaded shaft has a hexagonal shaped proximal end that can insert into the collet of an in-line, cordless electric screwdriver, and a set of retaining snap rings and circumferential grooves that position the twin threaded shaft in the stationary bearing.

7. A mechanized corkscrew as claimed in claim 2, wherein said spring is a compression spring that when fully compressed has a decompression force of approximately 30 Kg.

8. A mechanized corkscrew as claimed in claim 1, wherein said cork chock is a graduated ridge that runs along a distal longitudinal sectional portion of the receiving chamber.

9. A mechanized corkscrew as claimed in claim 1, wherein an exterior surface of the tubular slide of the sliding element is lined with graduations which indicate how far the cork has been extracted.

10. A mechanized corkscrew as claimed in claim 1, wherein the housing has a quick connect means for rapidly fastening the corkscrew apparatus to the mechanized power source.

* * * * *